US006469428B1

(12) United States Patent
Thiel et al.

(10) Patent No.: US 6,469,428 B1
(45) Date of Patent: Oct. 22, 2002

(54) LAMP WITH A MECHANICAL BASE

(75) Inventors: Joachim Thiel, Berlin (DE); Ernst Muehlich, Berlin (DE); Dieter Trypke, Falkensee (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/455,557

(22) Filed: Dec. 6, 1999

(30) Foreign Application Priority Data

Dec. 9, 1998 (DE) ..... 198 56 871

(51) Int. Cl.[7] ..... H01J 5/48; H01J 5/50

(52) U.S. Cl. ..... 313/318.09; 313/318.07; 313/318.05; 362/226; 439/619

(58) Field of Search ..... 313/318.01, 318.02, 313/318.05, 318.07, 318.09, 318.1; 362/226; 439/619, 699.2

(56) References Cited

U.S. PATENT DOCUMENTS 4,630,880 A * 12/1986 Durand ..... 439/595
5,080,615 A * 1/1992 Kondo ..... 439/699.2
5,229,683 A * 7/1993 Eckhardt et al. ..... 313/318.01
5,286,223 A * 2/1994 Ogawa ..... 439/619
5,538,443 A * 7/1996 Inoue et al. ..... 439/619
6,075,318 A * 6/2000 Noll et al. ..... 313/318.07
6,217,387 B1 * 4/2001 Sawada et al. ..... 439/619

FOREIGN PATENT DOCUMENTS

| | | | |
|---|---|---|---|
| EP | 0261722 | 9/1987 | ..... H01J/5/58 |
| EP | 0668639 | 2/1995 | ..... H01R/33/09 |
| EP | 0668639 | 8/1995 | ..... H01R/33/09 |
| FR | 2468227 | 10/1979 | ..... H01R/33/04 |
| JP | 05041203 | 2/1993 | ..... H01J/5/60 |

* cited by examiner

*Primary Examiner*—Nimeshkumar D. Patel
*Assistant Examiner*—Mariceli Santiago
(74) *Attorney, Agent, or Firm*—William H. McNeill

(57) ABSTRACT

A lamp bulb (1) made from glass is sealed at one end by a pinch (2). A base (5) is fastened on the pinch (2) by means of a metal spring (6). The base (5) has a holder (7) loosely adapted to the pinch (2). The metal spring (6; 26) is bent in a U-shaped fashion and comprises a base part (11) and two limbs (12, 13) which embrace the pinch, the fastening of the base (5) being accomplished by virtue of the fact that one limb (12) is aligned essentially parallel to the longitudinal axis, but simultaneously has a transverse extent accessible to spring forces, the transverse extent of this limb being stressed by the holder (7) of the base.

1 Claim, 8 Drawing Sheets

LAMP WITH A MECHANICAL BASE

TECHNICAL FIELD

The invention proceeds from a lamp, in particular a high-pressure discharge lamp, in accordance with the preamble of claim 1. In particular, these are metal halide lamps, sodium high-pressure lamps or halogen incandescent lamps with a pinch at one end and a ceramic base, but also incandescent lamps with a conventional screw base.

PRIOR ART

EP-A 261 722 has already disclosed a high-pressure discharge lamp in which the base is fastened on the outer bulb by means of cement. This technique is expensive in terms of time, energy and material, because the cement must be heated up laboriously and, in addition, an inner part (steel strip) is used for inductive heating. In addition, problems arise with high loading, because cracks can arise in the cement, and regions of the cement can harden to different degrees. Finally, it has emerged that when these lamps are installed in special luminaires such high temperature loadings can occur that conditions resembling tropical ones with which the conventional cement cannot cope can occur. Moreover, it has emerged that the conventional cement reacts sensitively to extreme environmental conditions. For example, it tends to corrode in the case of air containing salt or sulfur.

On the other hand, there are known (EP-A 668 639) for incandescent lamps which are operated at low voltage, lamps with a mechanical base in the case of which a metal spring is snapped onto the broad side of the pinch. Reliable holding is performed here by latching the metal spring into a projection or a depression on the pinch.

SUMMARY OF THE INVENTION

It is the object of the present invention to provide a lamp in accordance with the preamble of claim 1 which can be produced simply and quickly and stands high loadings.

This object is achieved by means of the characterizing features of claim 1. Particularly advantageous refinements are to be found in the dependent claims.

Basically, the lamp according to the invention has a bulb made from glass which has a longitudinal axis and, as a rule, is sealed at one end by a pinch. This bulb is frequently the outer bulb of a discharge lamp or a halogen incandescent lamp which is produced from quartz glass or hard glass. It can also be the sole bulb of a discharge lamp or incandescent lamp.

In the normal case, two supply leads are guided outward on the pinch, and moreover a base is fastened by means of a metal spring (preferably made from spring steel). The base has a trough-shaped holder loosely adapted to the pinch. The metal spring is bent in a U-shaped fashion. It consists of a base part and two limbs which embrace the pinch. The fastening of the base on the bulb is accomplished by a double spring action of the spring. This takes place, in particular, by virtue of the fact that at least one limb (preferably two) is (are) aligned essentially parallel to the longitudinal axis, but simultaneously has a transverse extent accessible to spring forces, the limb being accommodated in the holder of the base, where its transverse extent is limited by the walls of the holder and thus stressed.

The metal spring is a stamped sheet-metal part or the like, which is bent to form a U. During installation, the metal spring is firstly pushed onto the pinch. It holds particularly well there when the bearing surface (mostly on the broad side, but also possibly the narrow side) has a ribbed structure. Moreover, the spacing between the two limbs before installation in the base should be somewhat smaller (in particular approximately 5 to 10%) than the assigned thickness of the pinch. This creates an adequate provisional retention of the metal spring on the pinch.

The greatest transverse extent of the metal spring, that is to say the spacing between the parts of the two limbs which are most widely separated from one another, is at this point in time, that is to say before the mounting of the base, somewhat larger than the assigned width of the holder in the base. The transverse extent of the metal spring is advantageously greater by approximately 5 to 20% than the transverse extent (that is to say, the width) of the holder of the base.

Given conventional dimensions, this corresponds to a transverse extent of the metal spring which is approximately 0.3 to 1 mm larger than the transverse extent of the holder of the base.

A simple implementation of the double spring action consists in that at least one limb is bent inward or outward, preferably in the direction of the transverse extent, in the shape of a channel, in particular with a cross section shaped in the fashion of a V. The stressing of the channel accomplishes the spring action after the mounting of the base. However, the channel can also be rotated by 90°, that is to say be aligned in the direction of the longitudinal axis.

The metal spring is advantageously constructed such that it has two symmetrical limbs. This halves the spring excursion to be overcome by each limb, as a result of which the material is subjected to less stress. Moreover, a symmetrical placing of the bulb in the base with respect to the longitudinal axis is thereby assured.

In a second embodiment, the limbs are asymmetrical, only one limb being of channel-shaped design, while the second limb is equipped with lateral ends which are rolled in. They serve the purpose of exact lateral fixing.

The base part of the metal spring advantageously runs at a spacing from the supply leads in a central fashion between the two supply leads. This spacing is particularly important in the case of high-pressure discharge lamps, in which a starting voltage of several kV may be required. Consequently, in these cases a particularly narrow base part is to be used, in order to avoid flashovers between a supply lead and the base part. It is favorable if the spacing of the base part from each supply lead is at least 3 mm.

With regard to a high starting voltage, such as is required in the case of immediate restarting, it is also necessary to ensure a minimum spacing of the limbs from the supply leads. This plays a role chiefly in the case of limbs in which a part, chiefly the attachment piece, is approximately as wide as the broad side of the pinch. Here, the lower edge of the attachment piece is preferably spaced at least 2 mm from the supply leads. The point is that a flashover is to be avoided in this direction, as well.

If possible, at least 1 mm of the spacing should be an air gap. This means that the lower edge of the attachment piece does not bear directly against the pinch, but is spaced from the broad side thereof. It is, furthermore, to be taken into account that shock-hazard protection should also be optimized during installation of the lamp for the safety of the customer. This is implemented by virtue of the fact that the free outer end of the limb ends in the holder at least 2 mm below the upper edge of the base.

A very special advantage flows from the technique, presented here, for fastening the base in the case of novel metal halide lamps with a ceramic discharge vessel, and in the case of sodium high-pressure lamps. Since the discharge vessel is sealed here at two ends for technical reasons, these lamps have an unusually large ratio of length to diameter of the outer bulb. Whereas in the case of conventional metal halide lamps this ratio is approximately 2:1 to 3:1, ceramic metal halide lamps (and sodium high-pressure lamps) can reach a ratio of length to diameter of more than 3:1. It has emerged that when these lamps are installed in the associated lamp holder (or luminaire) the tendency to cracks in the pinch of the outer bulb increases substantially when the base is fastened with cement. The cause is that the cement accomplishes a rigid connection between the outer bulb and base. Even a slight vibrational excitation (such as can be produced upon installing the lamp) suffices to load the outer bulb excessively, since in the case of the ratio of more than 3:1 discussed above it has an unfavorable resonance of the natural vibration. When a mechanical base with the metal spring according to the invention is provided, however, no absolutely rigid connection is produced between the base and bulb. Quite oppositely, the vibration is cushioned and damped by the metal spring, with the result that the risk of glass breakages is eliminated. On the other hand, in the case of the previously known provision of a mechanical base, that is to say without the metal spring according to the invention, it was not possible to achieve adequate fixing. Consequently, the optical quality was unsatisfactory upon installation in a reflector. This problem has now been solved.

FIGURES

The invention is to be explained in more detail below with the aid of a plurality of exemplary embodiments. In the drawings:

FIG. 1 shows a metal halide lamp, partially in section, in a side view (FIG. 1*a*), in a side view rotated by 90° (FIG. 1*b*) and in a plan view from below (FIG. 1*c*);

FIG. 2 shows the metal spring of FIG. 1 in three different views (FIGS. 2*a* to 2*c*) in accordance with FIG. 1;

FIG. 3 shows a further exemplary embodiment of a metal halide lamp, partially in section, in a side view (FIG. 3*a*), in a side view rotated by 90° (FIG. 3*b*) and in a plan view from below (FIG. 3*c*); and FIG. 4 shows the metal spring of FIG. 3 in three different views (FIGS. 4*a* to 4*c*) in accordance with FIG. 3.

DESCRIPTION OF THE DRAWINGS

Shown in FIG. 1 is a metal halide lamp with an outer bulb 1 made from hard glass (or quartz glass), which has a longitudinal axis and is sealed at one end by a known pinch 2 in the shape of a double T (sometimes also called I-shaped). The length L of the outer bulb is 6 cm, the outside diameter D is 2.2 cm, and the ratio L/D=2.7. Two supply leads 3 are guided outward on the pinch 2. They end in pins 4 which are inserted into a ceramic base 5. A discharge vessel 10 made of quartz glass, pinched at one end and having a filling of metal halides is inserted in the outer bulb.

The base 5 is fastened on the pinch 2 by means of a metal spring 6. The base 5 has an approximately rectangular trough-shaped holder 7, loosely adapted to the pinch 2, with indentations 21 on the broad sides. The metal spring 6 is bent in a U-shaped fashion. It consists of a base part 11 and two free limbs 12, 13 which jointly embrace the pinch. The base part 11 bears against the lower end of the pinch 2, while the limbs 12, 13 bear against the broad sides 8. The broad sides 8 of the pinch 2 are fluted over a majority of their surface (only partially shown by the reference number 14). The width of the base part 11 corresponds approximately to a third of the spacing between the supply leads 3.

Figure 1A:
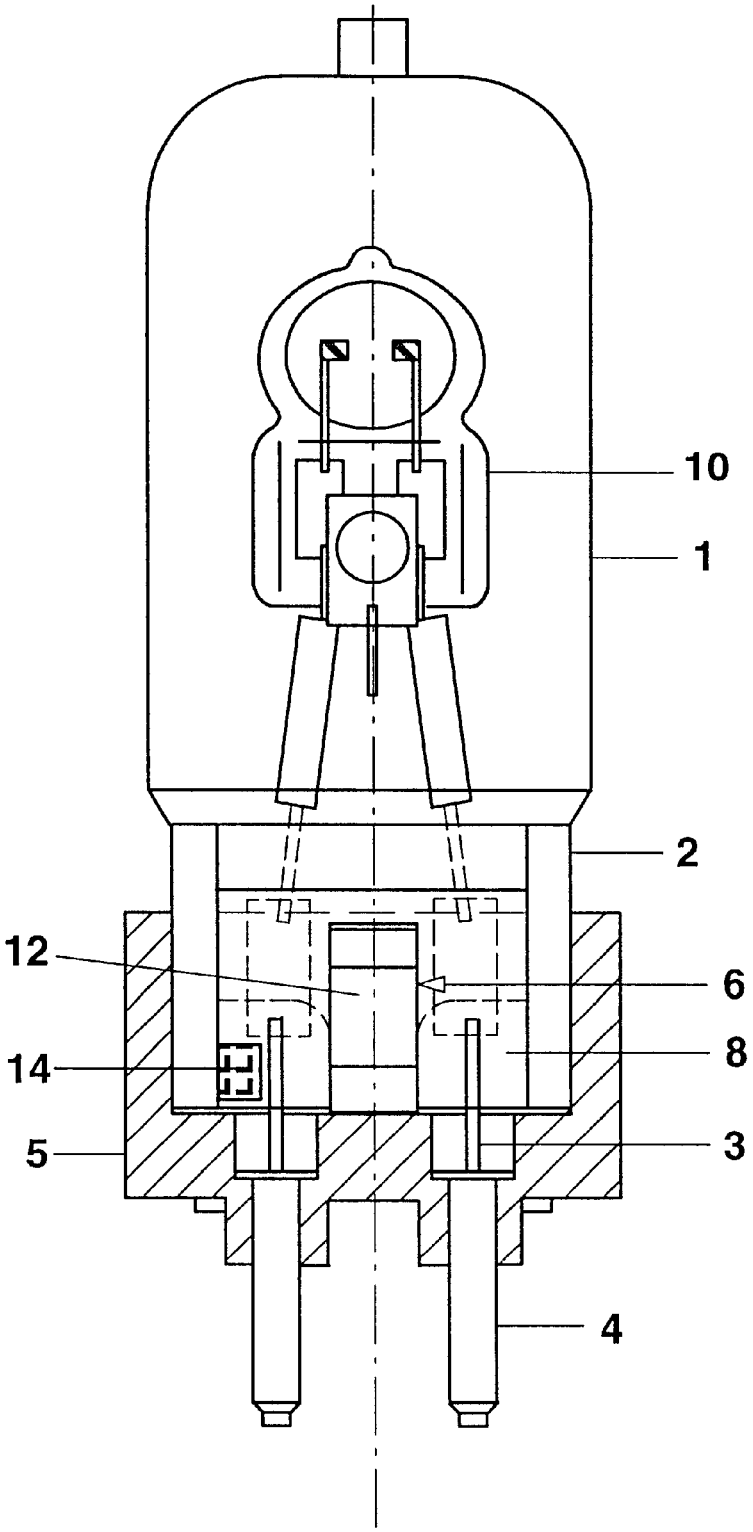
Figure 1B:
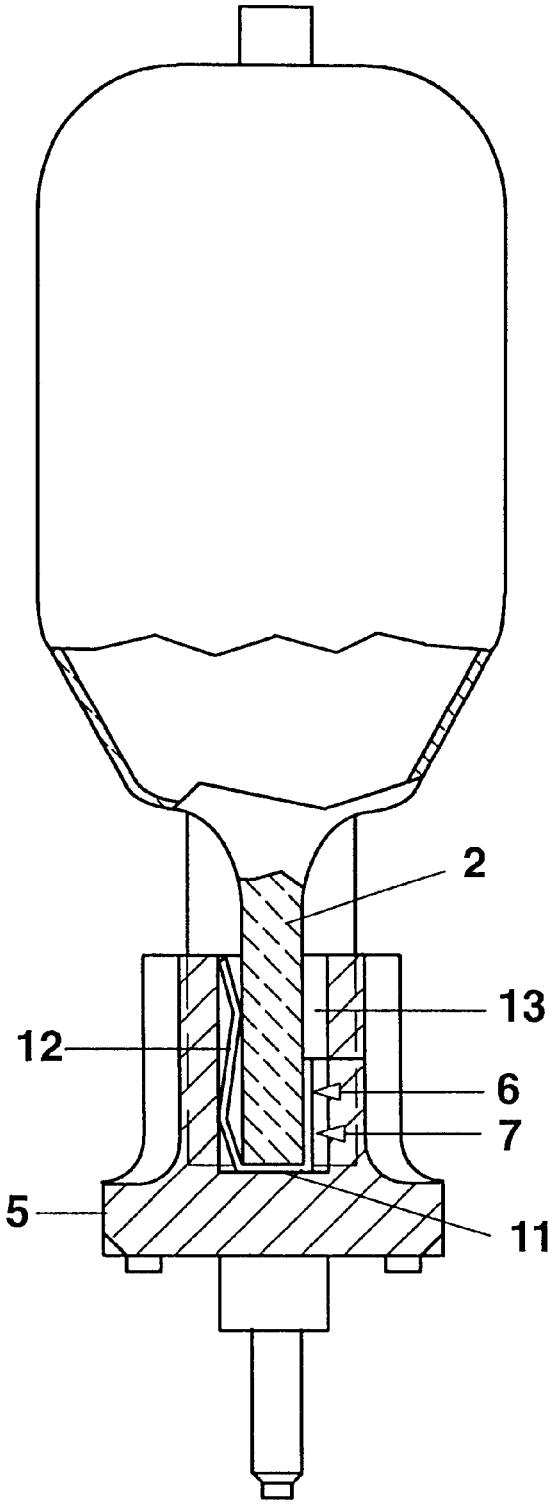
Figure 1C:
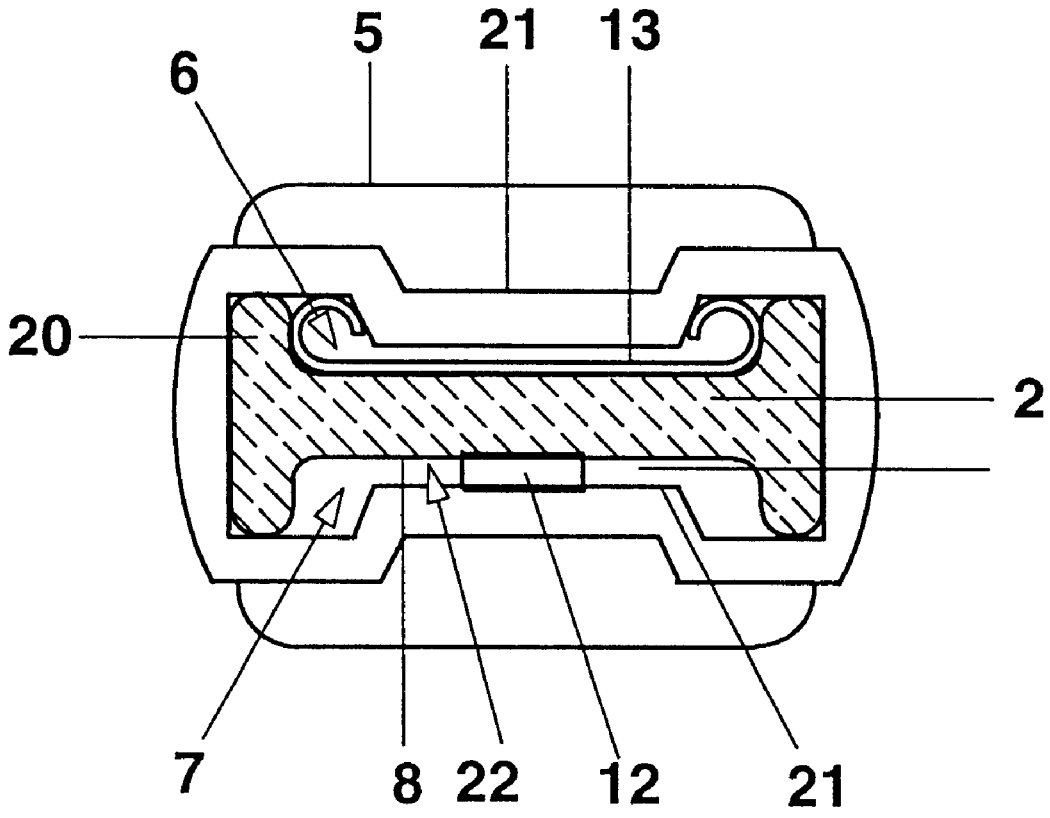
Figure 2A:
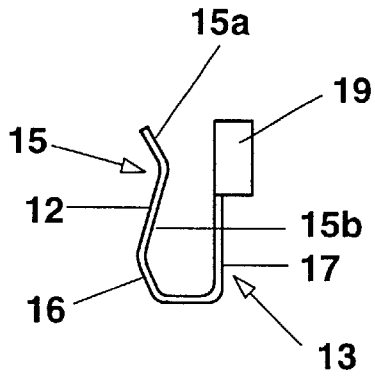
Figure 2B:
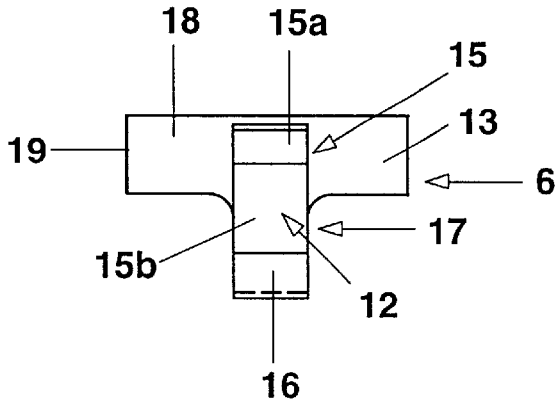
Figure 2C:
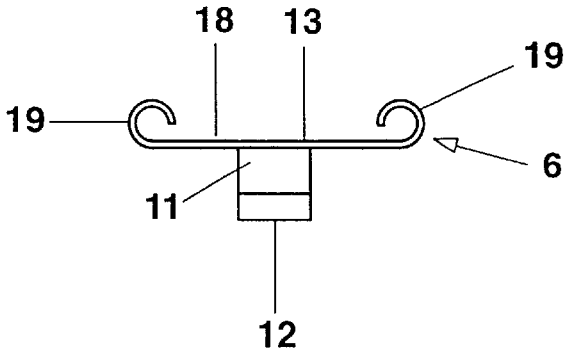

The metal spring 6 is shown once again in detail in various views in FIG. 2. It consists of a spring steel strip with a thickness of 0.3 mm. The first, narrow limb 12 is bent inward, that is to say toward the second limb, transverse to the longitudinal axis in a channel-shaped fashion. The channel 15 forms the shape of a V (or U) from two limbs 15*a*, 15*b*. Their inner limb 15*b* is connected to the base part via an attachment piece 16. The second, wide limb 13 of the metal spring is designed in a T-shape fashion such that a widened surface 18 is seated on a narrow neck 17. The lateral ends 19 of the surface 18 are rolled in to form three quarters of a circle. They fit exactly into the interspace between the widened narrow sides 20 of the pinch and the central indentation 21 on the broad side of the base (FIG. 1*c*). The metal spring 6 is thereby centered exactly in the middle.

The fastening of the base is accomplished by virtue of the fact that the limb 12 is clamped with its channel 15 into the narrow gap 22 between the indentation 21 of the holder and the pinch 2.

Figure 3A:
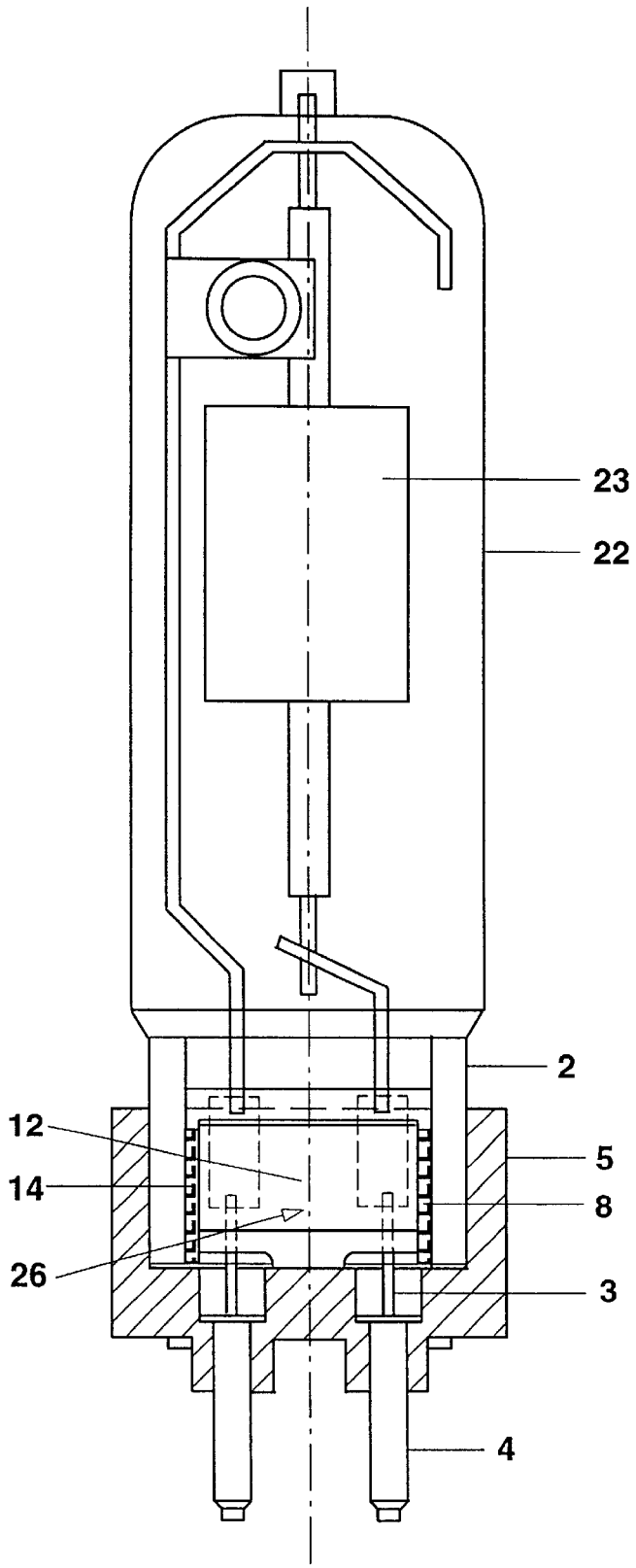
Figure 3B:
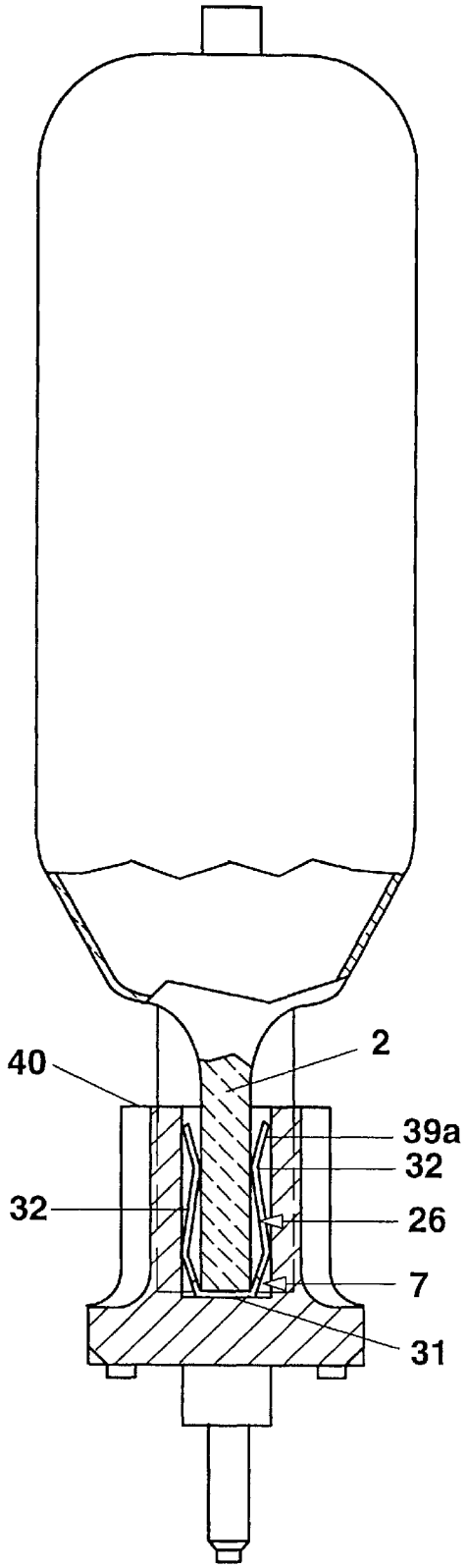
Figure 3C:
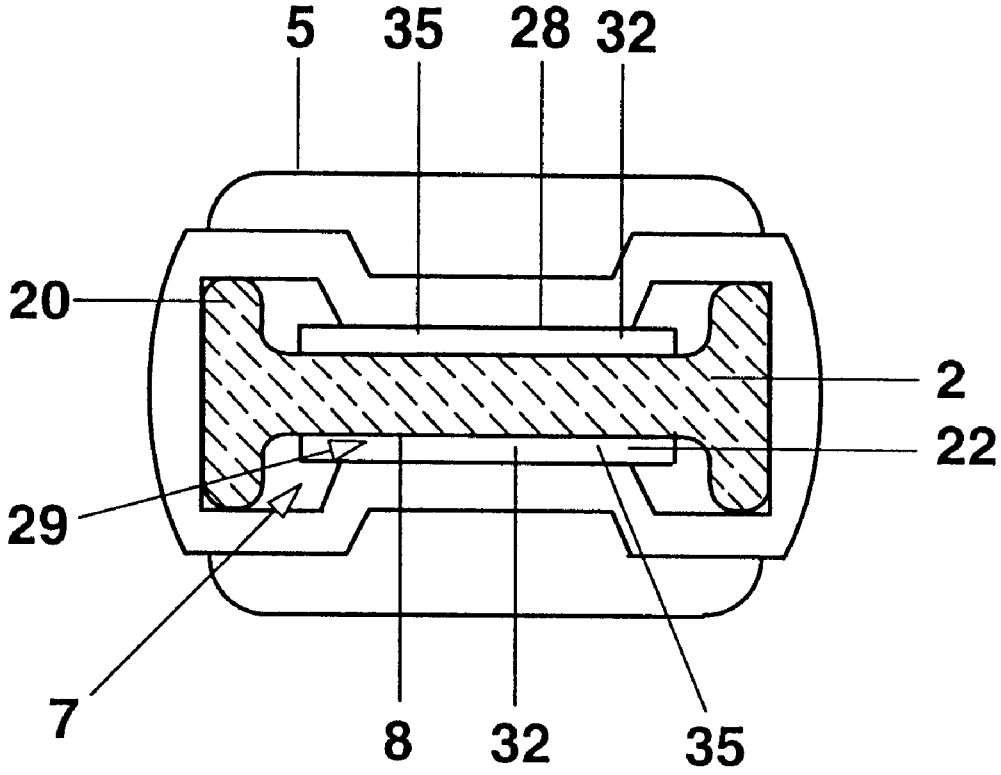

Shown in FIG. 3 is a metal halide lamp with an outer bulb 22 made from quartz glass (or hard glass) which has a longitudinal axis and is sealed at one end by a pinch 2. The length L of the outer bulb is 7.5 cm, the outside diameter D is 1.8 cm, and the ratio L/D=4.2. Two supply leads 3 are again guided outward to a ceramic base 5 on the pinch 2. A ceramic two-ended discharge vessel 23 with a filling of metal halides is inserted in the outer bulb.

The base 5 is fastened on the pinch 2 by means of a metal spring 26. The base 5 again has an approximately rectangular holder 7, loosely adapted to the pinch 2. The metal spring 26 is bent in a U-shaped fashion. It consists of a base part 31 and two free, symmetrically constructed limbs 32. The base part 31 bears against the lower end of the pinch 2, while the limbs 32 embrace the pinch. The width of the base part 31 is 5.5 mm and corresponds at least to a third of the spacing between the supply leads 3. The spacing of the base part from each supply lead is 3 mm. The width of the two limbs 32 is only slightly narrower than the broad side of the holder of the base. The limbs are bent inward, that is to say toward the pinch, in a channel-shaped fashion transverse to the longitudinal axis.

Figure 4A:
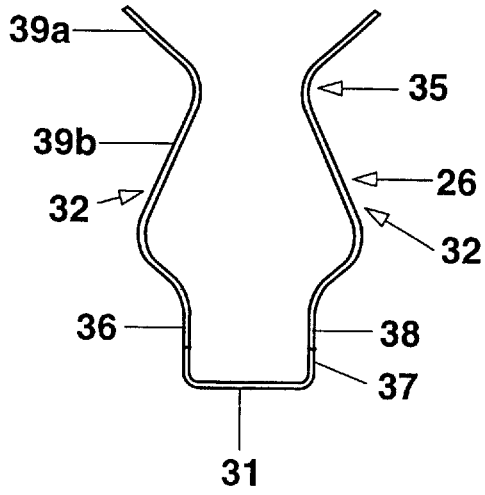
Figure 4B:
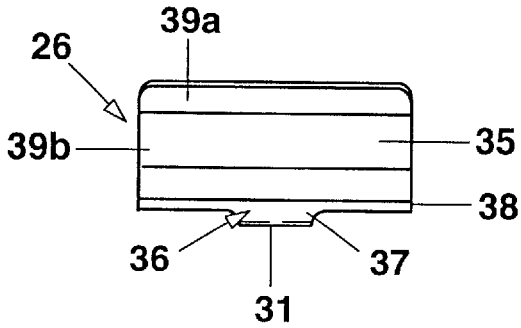
Figure 4C:
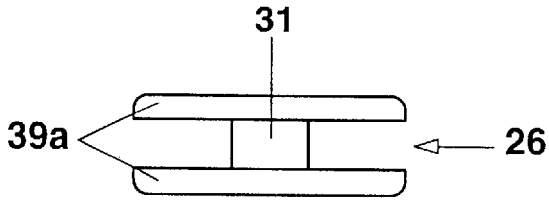

The metal spring 26 is shown again in detail in FIG. 4. It consists of a spring steel strip with a thickness of 0.2 mm. The channel 35 approximately forms the shape of a V (or U) from two limbs 39*a*, 39*b*. The two channel limbs 39*a*, 39*b* are, however, asymmetrical, since they are of different lengths and angled differently to the longitudinal axis. The outer limb 39*a* forms a first angle of 45° with the longitudinal axis, while the inner limb 39*b* is only half as strongly angled (second angle of 23°). The reason for this is that the outer limb exerts the actual holding function and therefore requires a stronger spring force than the inner limb, whose object is to center the bulb and protect it against tilting. Consequently, the first angle is preferably to be selected between 35° and 55°, while the second angle is to be selected between 15° and 35°. The first angle is advantageously larger (by at least 20%) than the second, there preferably being a ratio of approximately 2:1.

The inner channel limb 39*b* is connected to the base part 31 via an attachment piece 36. The attachment piece 36 is designed such that a widened surface 38 is seated on a narrow neck 37, so that it is approximately T-shaped overall. The widened surface 38 is bent outward on the channel side by approximately 45° with respect to the longitudinal axis. The lower edge of the transverse beam of the T (surface 38) is spaced by approximately 1 mm from the broad side of the pinch and removed overall by approximately 2.5 mm from the supply lead 3, in order to avoid flashovers during starting. The channel 35 is approximately as wide as the widened surface 38, that is to say the transverse beam of the T of the attachment piece 36.

The fastening of the base is accomplished by clamping the two channels 35 in the narrow gap 29 between the indentation 28 of the holder and the pinch 2.

The smallest spacing between the two limbs 32 in the relaxed state is 3.15 mm (see FIG. 4*a*). The distance at the joints between the attachment piece 36 and the inner channel limb 39*b* is 6.0 mm. The distance between the free ends of the outer limbs 39*a* of the channel is even 6.2 mm. The limbs 39*a*, 39*b* are thus not only asymmetrical, but the outer limb is also further spread so that a stronger spring force can act here.

By contrast, the width of the pinch (including fluting 14), measured at the broad sides, is approximately 3.3 mm. The width of the holder of the base in the region of the indentation 28 is approximately 5.9 mm.

The shock-hazard protection is ensured by virtue of the fact that the spacing of the free end of the limb from the upper edge 40 of the base is 2 mm.

What is claimed is:

1. A lamp having a bulb made from glass which has a longitudinal axis and is sealed at one end by a pinch, two supply leads being guided outward at the pinch, and a base being fastened on the pinch by means of a metal spring, wherein the base has a holder loosely adapted to the pinch, and wherein the metal spring is bent in a U-shaped fashion and comprises a base part and first and second limbs which embrace the pinch, the fastening of the base being accomplished by virtue of the fact that at least one of said first and second limbs is aligned essentially parallel to the longitudinal axis, but simultaneously has a transverse extent approximately 5 to 20% larger than the transverse extent of the holder of the base and wherein a second of said first and second limbs of the metal spring has lateral ends which are rolled in.

* * * * *